US010049634B2

(12) United States Patent
Zhang et al.

(10) Patent No.: US 10,049,634 B2
(45) Date of Patent: Aug. 14, 2018

(54) PIXEL CIRCUIT AND DRIVING METHOD THEREOF, DRIVING CIRCUIT, DISPLAY DEVICE

(71) Applicants: Boe Technology Group Co., Ltd., Beijing (CN); Beijing Boe Display Technology Co., Ltd., Beijing (CN)

(72) Inventors: Kan Zhang, Beijing (CN); Bin Zhang, Beijing (CN); Pengming Chen, Beijing (CN); Guangxing Wang, Beijing (CN); Qiang Zhang, Beijing (CN); Dianzheng Dong, Beijing (CN)

(73) Assignees: Boe Technology Group Co., Ltd. (CN); Beijing Boe Display Technology Co., Ltd. (CN)

( * ) Notice: Subject to any disclaimer, the term of this patent is extended or adjusted under 35 U.S.C. 154(b) by 0 days.

(21) Appl. No.: 15/521,666

(22) PCT Filed: Oct. 11, 2016

(86) PCT No.: PCT/CN2016/101752
§ 371 (c)(1),
(2) Date: Apr. 25, 2017

(87) PCT Pub. No.: WO2017/101573
PCT Pub. Date: Jun. 22, 2017

(65) Prior Publication Data

US 2018/0012555 A1 Jan. 11, 2018

(30) Foreign Application Priority Data

Dec. 16, 2015 (CN) ..... 2015 1 0939086

(51) Int. Cl.
*G09G 3/36* (2006.01)

(52) U.S. Cl.
CPC ..... *G09G 3/3659* (2013.01); *G09G 3/3696* (2013.01); *G09G 2320/0276* (2013.01); *G09G 2330/021* (2013.01)

(58) Field of Classification Search
CPC combination set(s) only.
See application file for complete search history.

(56) References Cited

U.S. PATENT DOCUMENTS 6,172,663 B1 1/2001 Okada et al.
2006/0044301 A1 3/2006 Ha
(Continued)

FOREIGN PATENT DOCUMENTS

CN 101231439 A 7/2008
CN 101963728 A 2/2011
(Continued)

OTHER PUBLICATIONS

International Search Report for International Patent Application No. PCT/CN2016/101752 dated Jan. 18, 2017.
(Continued)

*Primary Examiner* — Van N Chow
(74) *Attorney, Agent, or Firm* — Calfee, Halter & Griswold LLP

(57) ABSTRACT

The disclosure provides a pixel circuit and a driving method thereof, a driving circuit, and a display device, which pertains to the field of pixel driving technology. The pixel circuit includes a capacitor, a capacitor charging transistor, a first and second capacitor discharging transistor. The capacitor is charged to a first voltage greater than the pixel voltage when the capacitor charging transistor is turned on. The capacitor is connected in series with the first and second capacitor discharging transistor to form a discharge circuit, and the capacitor is discharged when the first and second capacitor discharging transistor are turned on so that the
(Continued)

voltage across the capacitor drops from the first voltage to the pixel voltage. There is no need to arrange a Gamma resistor for the driving circuit for the pixel circuit array provided by the disclosure, which makes the structure simple and the power consumption in driving low.

20 Claims, 4 Drawing Sheets

(56) References Cited

U.S. PATENT DOCUMENTS

| | | | | |
|---|---|---|---|---|
| 2008/0170195 | A1 | 7/2008 | Kwon et al. | |
| 2010/0123693 | A1 | 5/2010 | Utsunomiya | |
| 2011/0115778 | A1* | 5/2011 | Yang ..... | G09G 3/3655 345/212 |
| 2015/0262542 | A1 | 9/2015 | Lin et al. | |
| 2016/0210915 | A1* | 7/2016 | Wang ..... | G09G 3/3659 |

FOREIGN PATENT DOCUMENTS

| | | | |
|---|---|---|---|
| CN | 102065878 | A | 5/2011 |
| CN | 104050940 | A | 9/2014 |
| CN | 104537997 | A | 4/2015 |
| CN | 105047166 | A | 11/2015 |
| CN | 105096807 | A | 11/2015 |
| CN | 105405424 | A | 3/2016 |
| JP | 2006072360 | A | 3/2006 |

OTHER PUBLICATIONS

First Office Action for Chinese Patent Application No. 201510939086.9 dated Aug. 1, 2017.

Second Office Action for Chinese Patent Application No. 201510939086.9 dated May 31, 2018.

* cited by examiner

PIXEL CIRCUIT AND DRIVING METHOD THEREOF, DRIVING CIRCUIT, DISPLAY DEVICE

RELATED APPLICATION

The present application is the U.S. national phase entry of PCT/CN2016/101752, with an international filling date of Oct. 11, 2016, which claims the benefit of Chinese Patent Application NO. 201510939086.9 filed on Dec. 16, 2015, the entire disclosure of which is incorporated herein by reference.

FIELD OF THE INVENTION

The present disclosure pertains to the field of pixel circuit driving technology, and relates to a pixel circuit and driving method thereof, a driving circuit of a pixel circuit array formed based on the pixel circuit, and a display device.

BACKGROUND

On the glass substrate of a display, there is provided with a thin film transistor (TFT) array which generally consists of several pixel circuits arranged in rows and columns. Each pixel is provided with a corresponding pixel circuit which provides a corresponding pixel voltage to thereby control display of each pixel.

The existing pixel circuit is typically of a 1T1C structure, i.e. formed on the basis of a transistor (e.g. a TFT) plus a capacitor. Switching-on and switching-off for the transistor T is controlled by a gate signal (Gate) provided by the gate driver, and the capacitor C is charged by a source drive controller based on a data signal (Data), thereby reaching a certain pixel voltage. The pixel voltage may be used to drive liquid crystal for the corresponding pixel.

To achieve different grayscales, the pixel circuit needs to provide pixel voltages of different magnitudes, i.e. grayscale voltages. However, different grayscale voltages are usually provided by the Gamma circuit and the source driver of the TFT array. Specifically, the Gamma circuit needs to provide a plurality of fixed node voltages, which then will be divided finely by multiple Gamma resistors inside the source driver to obtain a plurality of digital voltage values (i.e. Gamma reference voltages) such as a 6-bit voltage value. Then they are subjected to digital-to-analog conversion and applied to the capacitor of the corresponding pixel circuit to generate a corresponding pixel voltage.

The biggest problem existing in driving such pixel circuit is leading to relatively large logic power consumption and a relatively complex driving circuit for TFT array. Furthermore, since the grayscale voltages for the RGB sub-pixels must be shared, to realize an 8-bit voltage value, the cost in control is higher, the algorithm is complicated, and the debugging cycle is long.

SUMMARY

An objective of the present disclosure is to avoid usage of a Gamma resistor to drive the pixel circuit, so as to reduce the driving power consumption of the pixel circuit.

To achieve the above objective or other objectives, the present disclosure provides the following technical solutions.

According to an aspect of the disclosure, there is provided a pixel circuit for providing a pixel voltage, the pixel circuit being located in an N-th row of a pixel circuit array. The pixel circuit comprises: a capacitor; a capacitor charging transistor for charging the capacitor, a gate of the capacitor charging transistor being electrically connected to a gate line of a (N−1)-th row; a first capacitor discharging transistor, a gate of which is electrically connected to a gate line of the N-th row; and a second capacitor discharging transistor, a gate of which is electrically connected to a data line. The capacitor is charged to a first voltage greater than the pixel voltage when the capacitor charging transistor is turned on; the capacitor is connected in series with the first capacitor discharging transistor and the second capacitor discharging transistor to form a discharge circuit; the capacitor is discharged when the first capacitor discharging transistor and the second capacitor discharging transistor are turned on so that a voltage across two terminals of the capacitor drops from the first voltage to the pixel voltage. N is an integer greater than or equal to 2.

In the pixel circuit according an embodiment of the invention, a drop from the first voltage to the pixel voltage is achieved by controlling at least discharge time for the capacitor.

In some embodiments, a data signal of the data line is a pulse width modulation signal, and turn-on time of the second capacitor discharging transistor is controlled by the pulse width modulation signal to thereby control the discharge time.

In the pixel circuit according to another embodiment of the invention, a turn-on degree of the second capacitor discharging transistor is controlled by controlling at least a voltage of the data line, thereby achieving a drop from the first voltage to the pixel voltage.

In the pixel circuit according to a further embodiment of the present invention, in the case of a positive frame, the first voltage is twice a liquid crystal molecule deflection reference voltage, the pixel voltage is a positive frame pixel voltage; in the case of a negative frame, the first voltage is the liquid crystal molecule deflection reference voltage, the pixel voltage is a negative frame pixel voltage.

In the pixel circuit according to any one of the above-described embodiments, a drain of the capacitor charging transistor is electrically connected to a first terminal of the capacitor, a source of the first capacitor discharging transistor is electrically connected to the first terminal of the capacitor, and a drain of the first capacitor discharging transistor is electrically connected to a source of the second capacitor discharge transistor.

In some embodiments, the pixel circuit is arranged corresponding to an R sub-pixel, a G sub-pixel and a B sub-pixel of an RGB pixel, respectively, thereby providing a corresponding independent pixel voltage to the R sub-pixel, the G sub-pixel and the B sub-pixel, respectively.

In embodiments of the invention, pixel circuits of a first row in the pixel circuit array have a same circuit structure as pixel circuits of other rows, and the gate of the capacitor charging transistor in the pixel circuits of the first row is used for receiving a STV signal (start signal of one-frame image).

According to another aspect of the present disclosure, there is provided a driving method for the pixel circuit described above, comprising:

during a charging phase, turning on the capacitor charging transistor by a gate signal (Gate (N−1)) of the gate line of the (N−1)-th row, thereby charging the capacitor to the first voltage greater than the pixel voltage;

during a discharging phase, turning on the first capacitor discharging transistor by a gate signal (Gate N) of the gate line of the N-th row, turning on the second capacitor discharging transistor by a data signal (Data) of the data line, the capacitor being discharged so that a voltage across the capacitor drops from the first voltage to the pixel voltage.

during a holding phase, turning off the capacitor charging transistor and turning off at least one of the first capacitor discharging transistor and the second capacitor discharging transistor to keep the pixel voltage substantially unchanged.

In the driving method according to an embodiment of the invention, in the case of a positive frame, the first voltage is twice a liquid crystal molecule deflection reference voltage biased on a common electrode, the pixel voltage is positive frame pixel voltage; in the case of a negative frame, the first voltage is equal to the liquid crystal molecule deflection reference voltage biased on the common electrode, the pixel voltage is a negative frame pixel voltage.

In the driving method according to another embodiment of the present invention, a drop from the first voltage to the pixel voltage is achieved by controlling at least discharge time for the capacitor.

In some embodiments, the data signal of said data line is a pulse width modulation signal, and turn-on time of the second capacitor discharging transistor is controlled by the pulse width modulation signal to thereby control the discharge time.

In the driving method according to a further embodiment of the invention, a turn-on degree of the second capacitor discharging transistor is controlled by controlling at least a voltage of the data line, thereby achieving a drop from the first voltage to the pixel voltage.

In the driving method according to any one of the above-described embodiments, time of the charging phase and/or the discharging phase is in the order of microseconds.

According to a further aspect of the disclosure, there is provided a driving circuit for a pixel circuit array comprising a plurality of pixel circuits according to any one of the above embodiments arranged in rows and columns, the driving circuit includes a charging power supply for providing a charging voltage for charging the capacitor to the first voltage greater than the pixel voltage; a gate drive module for providing a gate signal to the gate line; a pixel voltage control module configured to provide a data signal to the data line which turns on the second capacitor discharging transistor to enable a voltage across the capacitor to drop from the first voltage to the pixel voltage.

In the driving circuit according to an embodiment of the present invention, the pixel voltage control module comprises a pulse width controller for outputting a pulse width modulation signal, a pulse width of the pulse width modulation signal is configured to control the discharge time of the capacitor.

In some embodiments, the pixel voltage control module comprises a level shifter for controlling a magnitude of a high level of the pulse width modulation signal so as to control the turn-on degree of the second capacitor discharging transistor.

In some embodiments, the pixel voltage control module further comprises a shift register at least for receiving a digital driving signal and temporarily storing it; and an output buffer at least for outputting the pulse width modulation signal.

In the driving circuit according to another embodiment of the present invention, the charging power supply comprises a third transistor and a fourth transistor. The third transistor and the fourth transistor are mutually complementary transistors. A drain of the third transistor and a drain of the fourth transistor are both electrically connected to an output of the charging power supply, and a gate of the third transistor and a gate of the fourth transistor are controlled by a polarity reversal control signal.

In some embodiments, in the case of a positive frame, the third transistor is turned on and is inputted with a voltage twice the liquid crystal molecule deflection reference voltage biased on the common electrode; in the case of a negative frame, the fourth transistor is turned on and is inputted with the liquid crystal molecule deflection reference voltage biased on the common electrode.

According to still another aspect of the present disclosure, there is provided a display device comprising a pixel circuit array including a plurality of pixel circuits as described above arranged in rows and columns, and a driving circuit described above.

The technical effect of the embodiments provided by the present invention is that there is no need to provide a Gamma resistor for the driving circuit for the pixel circuit array, which makes the structure simple, the driving circuit easier to realize, and the power consumption during the driving process low. Furthermore, in the charging phase, the capacitor C is firstly charged to a voltage higher than the pixel voltage, which can produce an overdrive effect to some extent on the liquid crystal corresponding to pixel, thereby facilitating speeding up the liquid crystal response.

BRIEF DESCRIPTION OF THE DRAWINGS

The above and other objectives and advantages of the present disclosure will become more complete and clear from the detailed description below with reference to the accompanying drawings.

DETAILED DESCRIPTION OF EMBODIMENTS

Figure 1:
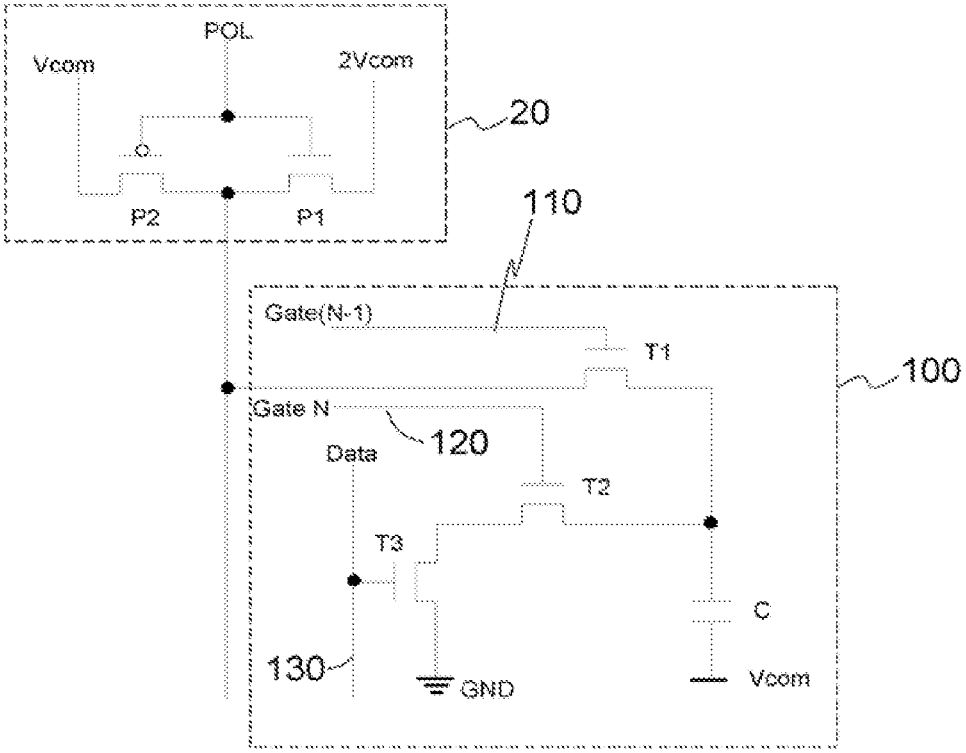
FIG. 1 is a schematic view showing the basic structure of a pixel circuit according to an embodiment of the present invention.

The present disclosure will now be described more comprehensively with reference to the accompanying drawings, in which exemplary embodiments of the invention are illustrated. However, the present invention may be carried out in many different forms and should not be construed as being limited to the embodiments set forth herein. Rather, these embodiments are provided to make the present disclosure become thorough and complete, and will fully convey the concept of the disclosure to a person having an ordinary skill in the art. In the drawings, the same reference numerals refer to the same elements or components, and therefore, the description thereof will be omitted.

FIG. 1 is a schematic view showing the basic structure of a pixel circuit according to an embodiment of the invention. In this embodiment, FIG. 1 illustrates a pixel circuit 100, which mainly comprises a capacitor C and transistors T1-T3. A plurality of pixel circuits 100 may form a pixel circuit array, for example, a pixel circuit array formed on a TFT glass substrate. The pixel circuit array may be one of the core components for the display panel, and may control the liquid crystal module. Each pixel circuit 100 may control display for a single pixel or sub-pixel. Specifically, the capacitor C provides a corresponding pixel voltage to control the grayscale for a single pixel or sub-pixel.

The capacitor C may be an equivalent capacitor (also referred to as a "liquid crystal capacitor") formed by a pixel electrode on the TFT substrate and a common electrode of a CF (color film) substrate above the TFT substrate, and may also be a storage capacitor disposed in the pixel circuit. The pixel electrode can be understood as a first terminal of the capacitor C of the pixel circuit 100 in the embodiment of the present invention. In this embodiment, the common electrode for forming the other terminal (a second terminal) of the capacitor C has a predetermined voltage Vcom (as shown in FIG. 1), which is a liquid crystal molecule deflection reference voltage and provides a reference for the polarity of the pixel voltage of the pixel electrode. If the pixel voltage of the pixel electrode is greater than Vcom, the pixel voltage is referred to as a positive polarity voltage. If the pixel voltage of the pixel electrode is smaller than Vcom, the pixel voltage is referred to as a negative polarity voltage. Both the pixel electrode and the common electrode can be fabricated by patterning ITO material.

As shown in FIG. 1, the pixel circuit 100 may be one of the units that constitute a pixel circuit array having L rows and X columns. The pixel circuit 100 may be located in the N-th row of the array, N being less than or equal to L. However, it should be understood that the specific position of the pixel circuit 100 in the pixel circuit array is not limited.

The transistor T1 may be a capacitor charging transistor, the drain of which is electrically connected to the first terminal of the capacitor C, i.e. connected to the pixel electrode, the gate of which is electrically connected to a gate line (or scanning line) 110 of the (N−1)-th row, and the source of which is electrically connected to an external charging power supply 20. The external charging power supply includes transistors P2 and P1 connected in series, which are complementary transistors. The gates of the transistors P2 and P1 are both connected to a POL (polarity inversion control) signal so that the transistor P1 is turned off when the transistor P2 is turned on, and the transistor P2 is turned off when the transistor P1 is turned on. A voltage of 2Vcom is provided to source of the transistor P1, and a voltage of Vcom is provided to the source of the transistor P2. The drain of the transistor P2 is electrically connected with the drain of the transistor P1 and serves as the output terminal of the charging power supply 20. The charging power supply 20 outputs a charging voltage of 2Vcom when the transistor P1 is turned on, and outputs a charging voltage of Vcom when the transistor P2 is turned on.

The transistor T1 is controlled by a signal Gate (N−1) transmitted by the gate line 110. When the transistor T1 is turned on, it indicates that the capacitor charging phase is started, so that the capacitor C can be charged by the charging power supply 20. At that time, the source of the transistor T1 can be supplied with the output of the external charging power supply 20. When the transistor P1 of the charging power supply is turned on, the source of the transistor T1 is supplied with a voltage of 2Vcom and the first terminal of the capacitor C can be charged to a voltage level of about 2Vcom. When the transistor P2 of the charging power supply is turned on, the source of the transistor T1 is supplied with a voltage of Vcom and the first terminal of the capacitor C can be charged to a voltage level of about Vcom. Thus, the first terminal of the capacitor C can be charged to a voltage level of Vcom or 2Vcom.

As shown in FIG. 1, the transistors T2 and T3 are capacitor discharging transistors. The gate of the transistor T2 is electrically connected to a gate line (or scanning line) 120 of the N-th row, and the source thereof is electrically connected to the first terminal of the capacitor C, and the drain thereof is electrically connected to the source of the discharging transistor T3. The drain of the transistor T3 may be grounded (i.e., connected to GND), and the gate of the transistor T3 is electrically connected to a data line 130. Therefore, the capacitor C is connected in series with the capacitor discharging transistor T2 and the capacitor discharging transistor T3 to form a discharge circuit. When the capacitor discharging transistors T2 and T3 are both turned on, the capacitor C can be discharged via the discharge circuit. The transistor T2 is controlled by a signal Gate N transmitted by the gate line 120, and the transistor T3 is controlled by a data signal Data transmitted by the data line 130. In this embodiment, when the transistor T2 and the transistor T3 are both turned on, it indicates that the pixel circuit 100 enters the discharging phase. The discharge time and/or discharge speed of the capacitor C is further controlled by controlling the turn-on time or turn-on degree for the capacitor discharging transistor T3, thereby controlling the voltage of the capacitor C after discharging, i.e. pixel voltage. The principle of controlling the pixel voltage by controlling the discharging process will be described in detail in the driving principle described later.

The turn-on degree of the transistor T3 can be represented by its equivalent resistance R. That is, the turn-on degree of the transistor T3 reflects the magnitude of its equivalent resistance R, and the higher the turn-on degree is, the smaller the equivalent resistance is. In the discharging circuit, the capacitor C and a resistor including the equivalent resistance R form an RC discharge circuit. The smaller the equivalent resistance R is, the larger the turn-on degree of the transistor T3 is, and the faster the discharge speed is.

Figure 2:
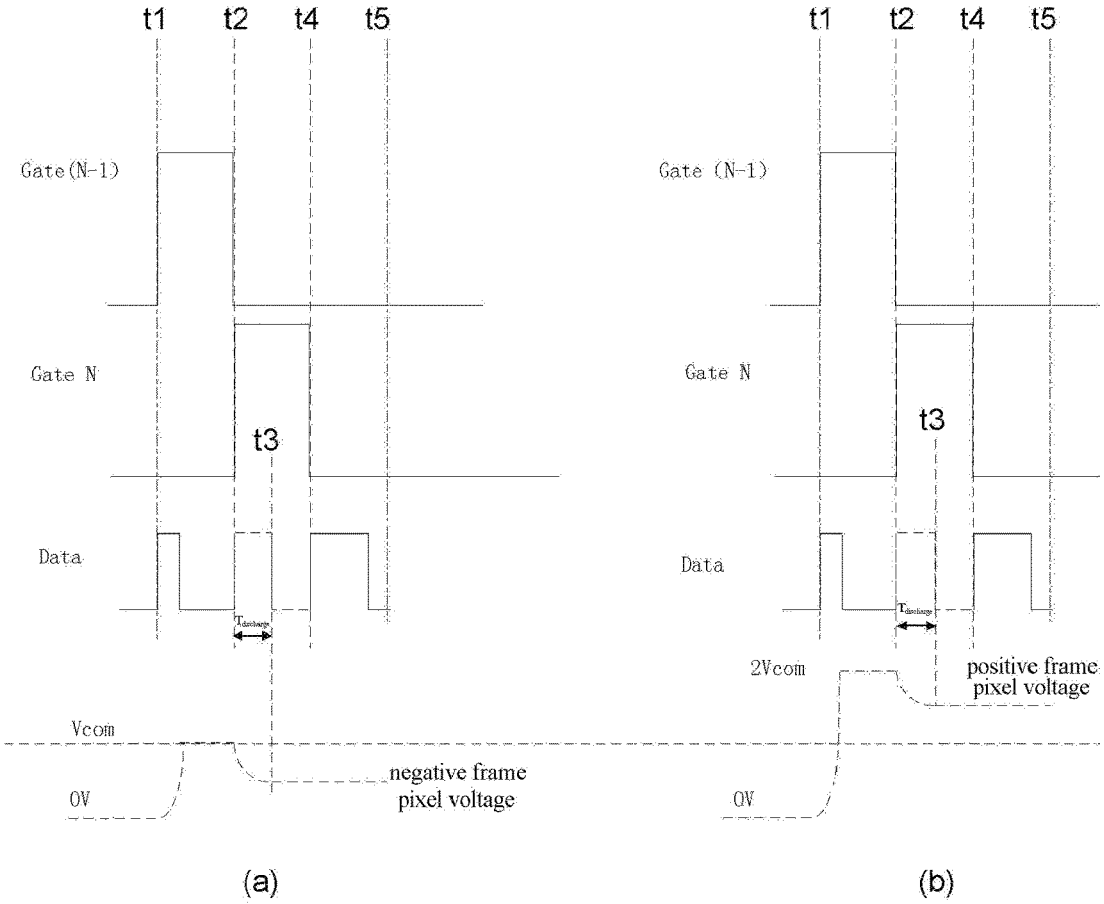
FIG. 2 is a schematic view illustrating the driving principle for a pixel circuit according to an embodiment of the present invention.

FIG. 2 is a schematic view showing the driving principle for a pixel circuit according to an embodiment of the present invention. Referring to FIGS. 1 and 2, the operation principle of the pixel circuit of the embodiment shown in FIG. 1 and the driving method thereof are illustrated. In this embodiment, a double-frame signal is used to drive the liquid crystal cell, that is, a positive frame and a negative frame are used to drive each pixel of the liquid crystal cell alternately, which facilitates avoiding image element retention that otherwise may eventually result in permanent image degradation. In the case of a positive frame, the pixel is applied with a positive electric field for positive polarity driving. At that time, the pixel electrode is biased with a positive polarity voltage, i.e. biased with a voltage greater than the common electrode voltage Vcom. In the case of a negative frame, the pixel is applied with a negative electric field for negative polarity driving. At that time, the pixel electrode is biased with a negative polarity voltage, i.e. biased with a voltage smaller than the common electrode voltage Vcom.

As shown in FIG. 2(*a*), it represents control for the pixel voltage in the case of a negative frame, in which a negative frame pixel voltage, i.e. a negative polarity voltage, can be obtained. Firstly, since the gate of the charging transistor T1 is electrically connected to the gate line 110 of the (N−1)-th row and thereby biased with the signal Gate (N−1) shown in FIG. 2(*a*), the gate of the transistor T1 is biased with a high level at time t1 so that the transistor T1 is turned on, indicating that the charging phase is started. At time t2, the signal Gate (N−1) becomes a low level, the transistor T1 is turned off, and the charging phase ends. In the period from t1 to t2, the charging power supply 20 outputs the voltage Vcom, the first terminal of the capacitor C is charged from 0 V to the voltage Vcom, and the voltage Vcom is greater than the negative polarity voltage obtained after the discharging of the capacitor. Moreover, in the period from t1 to t2, the signal Gate N is at a low level, and the discharge circuit for the capacitor C is cut off.

Meanwhile, at time t2, in the case of progressive scanning, the signal Gate N of the gate line 120 becomes a high level and the transistor T2 is turned on, and at time t2, the signal Data of the data line 130 becomes a high level and the transistor T3 is turned on, indicating that the discharging phase is started and the discharge circuit is completed so that the first terminal of the capacitor C starts to discharge from the voltage Vcom.

At time t3, the signal Data of the data line 130 becomes a low level, the transistor T3 is turned off, the discharging ends, and the capacitor C is discharged to a predetermined negative frame pixel voltage (which is less than Vcom); and during the period from t3 to t5, the negative frame pixel voltage is substantially maintained, so that negative polarity driving is generated for the corresponding pixel, enabling reversal of the liquid crystal. The difference of the negative frame pixel voltage with respect to the voltage Vcom determines the degree of reversal of the liquid crystal molecules, thereby controlling the grayscale of the pixel.

Therefore, the period from t2 to t3 is discharge time, i.e. $T_{discharge}$. In this embodiment, the discharge charge amount of the capacitor C can be controlled by controlling the length of the discharge time $T_{discharge}$, so that the magnitude of the negative frame pixel voltage can be controlled, and therefore, a desired negative frame pixel voltage can be achieved.

In the case of a negative frame shown in FIG. 2(*a*), the driving process mainly includes a charging phase in the period from t1 to t2, a discharging phase in the period from t2 to t3, and a holding phase in the period from t3 to t5.

As shown in FIG. 2(*b*), it represents control for the pixel voltage in the case of a positive frame so as to obtain a positive frame pixel voltage, i.e. a positive polarity voltage. Its working principle is substantially the same as in the case of a negative frame, i.e. including a charging phase in the period from t1 to t2, a discharging phase in the period from t2 to t3, and a holding phase in the period from t3 to t5. The difference is that, in the charging phase, the charging power supply 20 outputs the voltage 2Vcom, and the first terminal of the capacitor C is charged from 0 V to the voltage 2Vcom, that is, the pixel electrode is charged to the voltage 2Vcom that is greater than a positive frame pixel voltage desired to be obtained after discharging of the capacitor C. In the discharging phase, the voltage at the first terminal of the capacitor C drops from 2Vcom to the desired positive frame pixel voltage, which is greater than the voltage Vcom of the common electrode and can be selected in the range of Vcom to 2Vcom. Moreover, in the period from t3 to t5, the positive frame pixel voltage is substantially maintained, so that positive polarity driving is generated for the corresponding pixel, enabling reversal of the liquid crystal. The difference of the positive frame pixel voltage with respect to the voltage Vcom determines the degree of reversal of the liquid crystal molecules, thereby controlling the grayscale of the pixel.

In an embodiment, the data signal Data is a pulse width modulation signal, which modulates the pulse width based on the charging voltage, the pixel voltage desired to be obtained by pulse width modulation technique so as to control the length of $T_{discharge}$, such that the pixel voltage obtained after discharging of the capacitor is a pixel voltage desired to be obtained.

Figure 3:
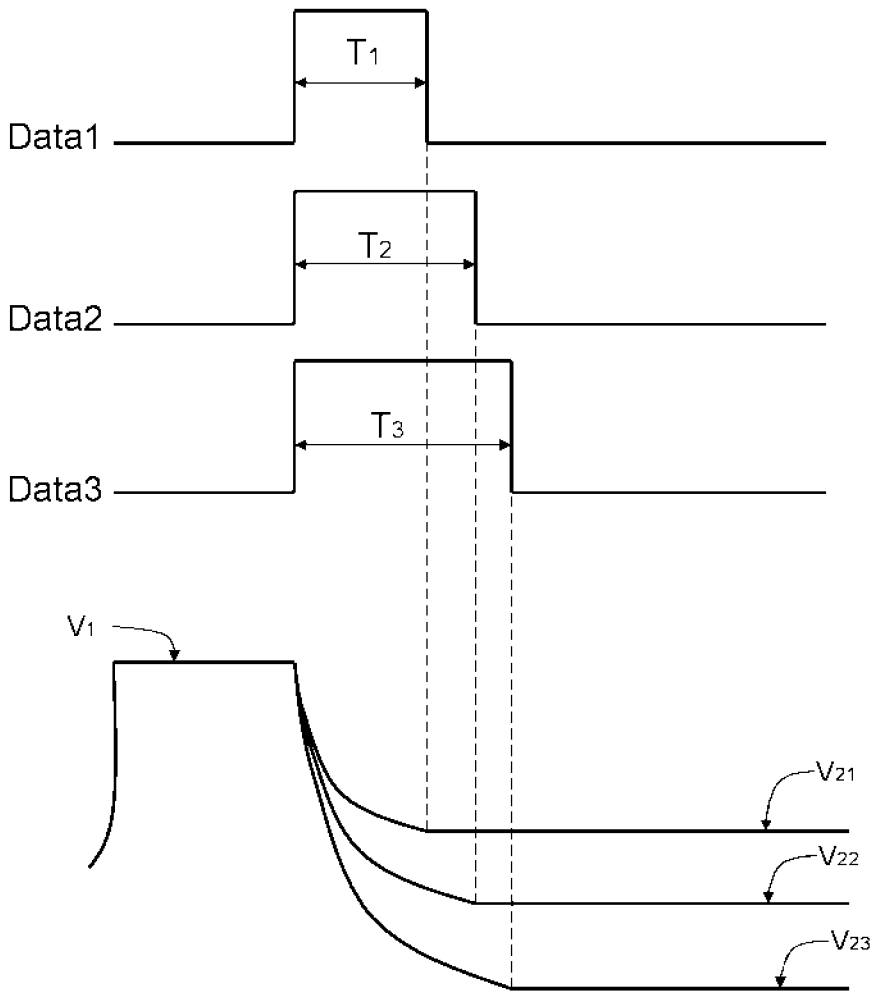
FIG. 3 is a schematic view illustrating the principle of using pulse width modulation technique to control the pixel voltage in embodiments of the present invention.

FIG. 3 is a schematic view illustrating the principle of using pulse width modulation technique to control the pixel voltage in embodiments of the present invention. As shown in FIG. 3, Data1, Data2 and Data3 are data signals in the form of pulse, which have different pulse widths $T_1$, $T_2$ and $T_3$ respectively. $V_1$ is a charging voltage of the pixel electrode after charged, $V_{21}$ is a pixel voltage of the pixel electrode obtained using the corresponding data signal Data1 to control the discharging process, $V_{22}$ is a pixel voltage of the pixel electrode obtained using the corresponding data signal Data2 to control the discharging process, and $V_{23}$ is a pixel voltage of the pixel electrode obtained using the corresponding data signal Data3 to control the discharging process. It can be seen that in the case where the data signals Data1, Data2 and Data3 are modulated to have different pulse widths, corresponding different pixel voltages can be obtained. It should be understood that FIG. 3 only illustrates obtaining three data signals with different pulse widths by modulation to thereby obtain three different pixel voltages. According to the teaching of the example, on the basis of the established discharge model of the capacitor C, it is possible to obtain more pixel voltages based on the pulse width modulation technique, which can be achieved only by controlling the pulse width of the data signal. As a result, it becomes simpler to obtain more pixel voltages.

In a further embodiment, when the discharge time $T_{discharge}$ is fixed, it is also possible to control the magnitude of voltage of the high level of the data signal Data so as to control the turn-on degree of the capacitor discharging transistor T3, thereby controlling the discharge speed such that the pixel voltage obtained after discharging of the capacitor is a pixel voltage desired to be obtained. The magnitude of voltage of the high level of the data signal Data can also be adjusted and set based on the charging voltage, the pixel voltage desired to be obtained, the discharge time $T_{discharge}$, and the like.

In the above embodiment, in the liquid crystal cell to which the pixel circuit 100 corresponds, the liquid crystal thereof can be alternately reversed under the driving of the positive frame pixel voltage and the negative frame pixel voltage, so as to prevent damage in the characteristics of the liquid crystal due to being biased under the same polarity voltage too long.

The pixel circuit 100 of the embodiment shown in FIG. 1 may be provided corresponding to the pixel or sub-pixel of the display panel. For example, for each RGB pixel, the pixel circuit 100 shown in FIG. 1 may be provided for each R sub-pixel, G sub-pixel and B sub-pixel, respectively. The pixel voltages independently provided by the three pixel circuits 100 to the R sub-pixel, the G sub-pixel and the B sub-pixel respectively may be the same or different. In the case where the pixel voltages provided to the R sub-pixel, the G sub-pixel and the B sub-pixel are the same, it is not necessary to perform voltage adjustment on the basis of the common Gamma voltage in order to obtain a predetermined sub-pixel transmittance.

Figure 4:
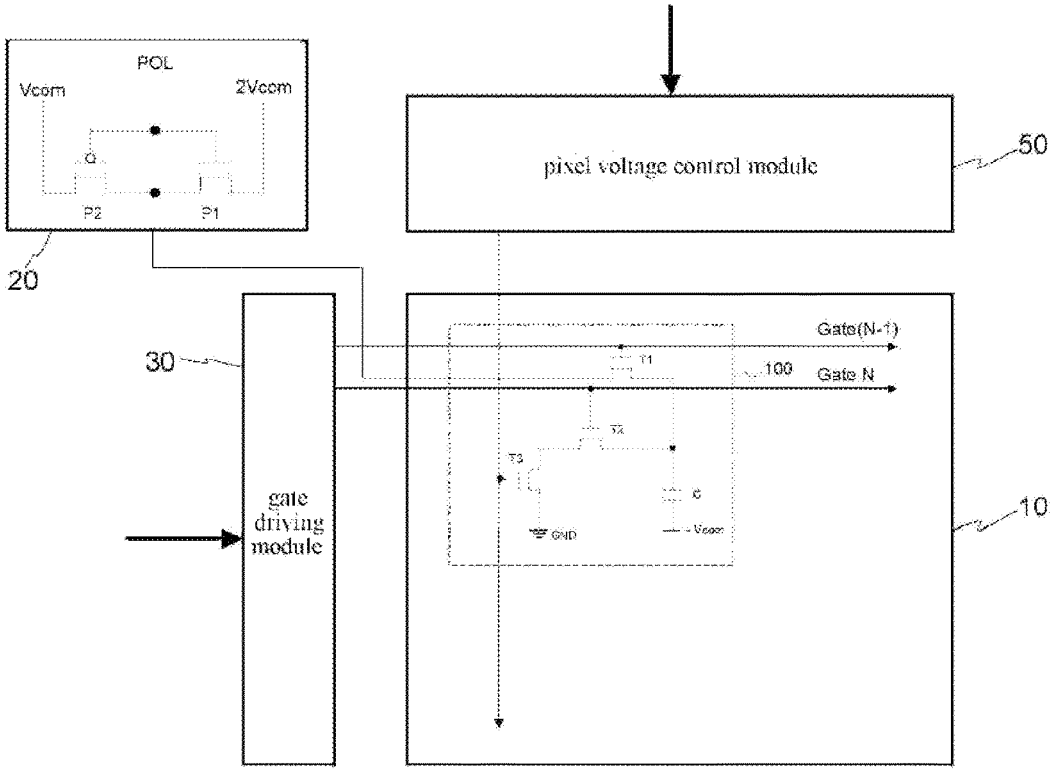
FIG. 4 is a schematic view of a driving circuit for a pixel circuit array according to an embodiment of the present invention.
Figure 5:
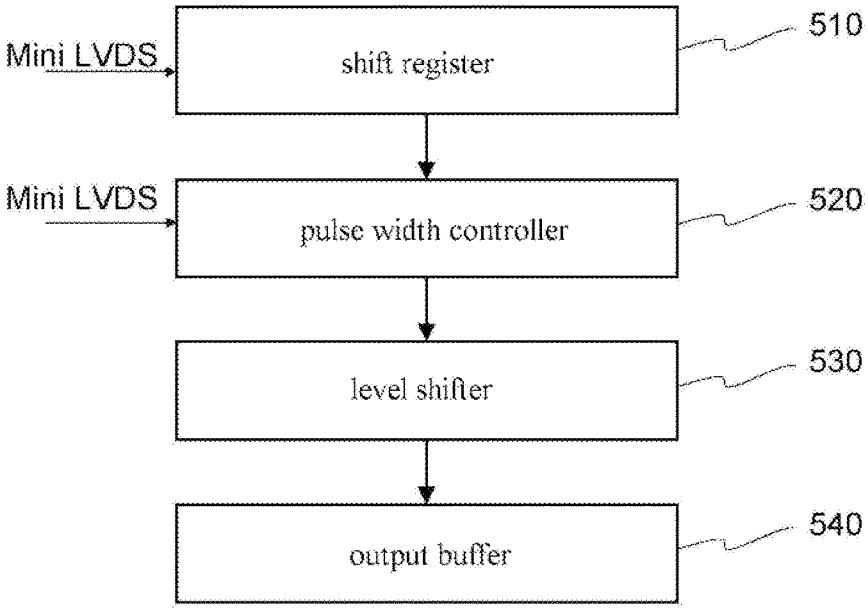
FIG. 5 is a schematic view showing the modular structure of a pixel voltage control module according to an embodiment of the present invention.

FIG. 4 is a schematic view of a driving circuit for a pixel circuit array according to an embodiment of the present invention, and FIG. 5 is a schematic view showing the modular structure of a pixel voltage control module according to an embodiment of the present invention. In light of FIGS. 4 and 5, it will be appreciated that the driving control for the pixel circuit 100 of embodiments of the present invention becomes easy to realize and the driving power consumption is lower.

As shown in FIG. 4, a pixel circuit array 10 is formed by arrangement of L rows and X columns of pixel circuits 100, which may be formed on the TFT substrate. The structure of each pixel circuit 100 is substantially or completely the same as that of the pixel circuit 100 shown in FIG. 1. For illustration, there is shown a pixel circuit 100 located in the N-th row as shown in FIG. 1.

In the driving circuit, a gate driving module 30 is provided corresponding to the pixel circuit array 10, which outputs L gate signals to L rows of gate lines, respectively. Gate N denotes a gate signal outputted on the gate line of the N-th row (as shown in FIG. 2), and Gate (N−1) denotes a gate signal outputted on the gate line of the (N−1)-th row (as shown in FIG. 2). The gate driving module 30 may be coupled to a timing controller (not shown) of the driving circuit and inputted with signals such as sty (start signal of one-frame image), cpv (column clock pulse signal), and so on.

A pixel voltage control module 50 is further provided corresponding to the pixel circuit array 10, which outputs X data signals Data to X columns of data lines, respectively. The pixel voltage control module 50 may be coupled to a timing controller (not shown) of the driving circuit and inputted with digital signals such as sth (start signal of row data), cph (row clock pulse signal), load (control signal for data signal), and so on.

Referring to FIG. 5, in this embodiment, the pixel voltage control module 50 mainly comprises a shift register 510, a pulse width controller 520, a level shifter 530, and an output buffer 540. The shift register 510 may receive external digital driving signals such as sth, cph, load, and the like, and store them temporarily, and may also receive a low voltage differential signal (Mini LVDS). The pulse width controller 520 may also receive a low voltage differential signal (Mini LVDS) and receive a signal from the shift register 510 to generate a pulse width modulation signal, whose pulse width reflects the discharge time $T_{discharge}$ controlled by the data signal Data. In the embodiment, the pulse width modulation signal is level-converted in the level shifter 530 (for example, it is stepped up) so as to obtain a pulse width modulation signal at a predetermined level, i.e. the data signal Data shown in FIG. 2, which is outputted to the corresponding data line via the output buffer 540.

The driving control principle of the driving circuit for each pixel circuit in the pixel circuit array 10 is similar to that in FIG. 2. The gate drive module 30 provides the gate signals Gate (N−1), Gate N, the charging power supply 20 provides voltage of Vcom or 2Vcom, and the pixel voltage control module 50 provides the data signal Data, such as a data signal Data whose pulse width can be modulated, so that respective pixel circuits in the pixel circuit array 10 can be controlled to obtain corresponding pixel voltages.

The driving circuit may comprise a charging power supply 20 which is controlled by the signal POL and outputs a charging voltage of Vcom or 2Vcom. The example structure of the charging power supply 20 is shown in FIG. 1 and will not be repeated here. It is to be understood that the charging power supply 20 may be configured to provide a charging voltage different from Vcom or 2 Vcom, depending on charging voltages of different magnitudes required by the capacitor C in the pixel circuit 100 during the charging phase.

In an embodiment, the magnitude of the high level of the data signal Data may be predetermined and constant, that is, the turn-on degree of the transistor T3 during the discharging phase is substantially fixed. In the case that the turn-on degree is fixed, the discharge time is controlled based on the data signal Data with modulated pulse width, so that a pixel voltage level of a predetermined magnitude can be achieved. In other alternative embodiments, the magnitude of the high level of the output data signal Data may be controlled by the level shifter 530 so that the turn-on degree of the transistor T3 in the pixel circuit 100 can be controlled and adjusted, and the discharge speed can be controlled. Thus the discharging process can be finely controlled within a certain discharge time period, thereby obtaining a pixel voltage level of a predetermined magnitude from the charging voltage.

Herein, the turn-on degree of the transistor T3 can be represented by the magnitude of its equivalent resistance R. In the discharge circuit, the capacitor C and a resistor including the equivalent resistance R form an RC discharge circuit. The smaller the equivalent resistance R is, the higher the turn-on degree of the transistor T3 is, and the faster the discharge speed is. Based on the parameters of the transistor T3, the equivalent resistance or impedance R of the transistor T3 when its gate is biased at different voltage levels can be obtained by software simulation, and the corresponding pixel voltage obtained by discharging the capacitor C from a certain predetermined charging voltage when the transistor T3 is under the condition of different turn-on time and/or different gate voltages can be further calculated. The pixel voltage control module 50 can control the outputted data signal Data based on the result of calculation.

Thus, it can be appreciated that there is no need to provide Gamma reference voltages of different magnitudes in the peripheral driving circuit for the pixel circuit array 10, thus it is not necessary to arrange a complex Gamma resistor to drive the pixel circuit array 10 or provide different node voltages. Of course, it is also possible to not set a Gamma circuit. The driving circuit is easier to realize, the circuit structure is simple, and the logic power consumption of operation will also be greatly reduced.

It is to be further noted that, in the TFT-LCD, the deflection time of the liquid crystal in the liquid crystal cell driven by the pixel circuit array 10 is in the order of milliseconds, while the time of the charging phase (e.g. t1-t2) and the discharging phase (e.g. t2-t3) in the above-described embodiments is much less than the deflection time of the liquid crystal, which is, for example, in the order of microseconds. Consequently, the charging and discharging processes in the pixel circuit of embodiments of the present invention would not conflict with the deflection driving control for the liquid crystal. On the contrary, in the charging phase, the capacitor C is firstly charged to a voltage higher than the pixel voltage, which can produce an overdrive effect to some extent on the liquid crystal corresponding to the pixel, thereby facilitating speeding up the liquid crystal response.

The pixel circuit array 10 formed by arrangement of the pixel circuits 100 of the above-described embodiments, and the corresponding driving circuit may be used in a display panel, which is particularly applicable to an ADS panel or a TN panel.

The above examples mainly describe the pixel circuit of the disclosure as well as the driving method thereof and driving circuit. While only some of the embodiments of the present invention have been described, it will be understood by the person having an ordinary skill in the art that the present invention may be carried out in many other forms without departing from the gist and scope thereof. Accordingly, the described examples and embodiments are to be considered as illustrative and not restrictive, and that the present invention may encompass various modifications and substitutions without departing from the spirit and scope of the present invention as defined by the appended claims.

The invention claimed is:

1. A pixel circuit for providing a pixel voltage, the pixel circuit being located in an N-th row of a pixel circuit array, the pixel circuit comprising:

a capacitor;

a capacitor charging transistor for charging the capacitor, a gate of the capacitor charging transistor being electrically connected to a gate line of a (N−1)-th row;

a first capacitor discharging transistor, a gate of which is electrically connected to a gate line of the N-th row; and a second capacitor discharging transistor, a gate of which is electrically connected to a data line;

wherein the capacitor is charged to a first voltage greater than the pixel voltage when the capacitor charging transistor is turned on, the capacitor is connected in series with the first capacitor discharging transistor and the second capacitor discharging transistor to form a discharge circuit, wherein the capacitor is discharged when the first capacitor discharging transistor and the second capacitor discharging transistor are turned on so that a voltage across the capacitor drops from the first voltage to the pixel voltage, wherein N is an integer greater than or equal to 2, wherein the capacitor and the capacitor charging transistor are connected in series with a charging power supply, which provides a charging voltage for charging the capacitor to the first voltage greater than the pixel voltage.

2. The pixel circuit according to claim 1, wherein a drop from the first voltage to the pixel voltage is achieved by controlling at least discharge time for the capacitor.

3. The pixel circuit according to claim 2, wherein a data signal of the data line is a pulse width modulation signal, turn-on time of the second capacitor discharging transistor being controlled by the pulse width modulation signal to thereby control the discharge time.

4. The pixel circuit according to claim 1, wherein a turn-on degree of the second capacitor discharging transistor is controlled by at least controlling a voltage of the data line, thereby achieving a drop from the first voltage to the pixel voltage.

5. The pixel circuit according to claim 1, wherein in the case of a positive frame, the first voltage is twice a liquid crystal molecule deflection reference voltage, the pixel voltage is a positive frame pixel voltage; in the case of a negative frame, the first voltage is the liquid crystal molecule deflection reference voltage, the pixel voltage is a negative frame pixel voltage.

6. The pixel circuit according to claim 1, wherein a drain of the capacitor charging transistor is electrically connected to a first terminal of the capacitor, a source of the first capacitor discharging transistor is electrically connected to the first terminal of the capacitor, a drain of the first capacitor discharging transistor is electrically connected to a source of the second capacitor discharge transistor.

7. The pixel circuit according to claim 1, wherein the pixel circuit is arranged corresponding to an R sub-pixel, a G sub-pixel and a B sub-pixel of an RGB pixel, respectively, thereby providing a corresponding independent pixel voltage to the R sub-pixel, the G sub-pixel and the B sub-pixel, respectively.

8. The pixel circuit according to claim 1, wherein pixel circuits of a first row in the pixel circuit array have a same circuit structure as pixel circuits of other rows, and wherein the gate of the capacitor charging transistor in the pixel circuits of the first row is used for receiving a STV signal.

9. A driving method for the pixel circuit according to claim 1, comprising:

during a charging phase, turning on the capacitor charging transistor by a gate signal of the gate line of the (N−1)-th row, thereby charging the capacitor to the first voltage greater than the pixel voltage, during a discharging phase, turning on the first capacitor discharging transistor by a gate signal of the gate line of the N-th row, turning on the second capacitor discharging transistor by a data signal of the data line, the capacitor being discharged so that the voltage across the capacitor drops from the first voltage to the pixel voltage, during a holding phase, turning off the capacitor charging transistor and turning off at least one of the first capacitor discharging transistor and the second capacitor discharging transistor to keep the pixel voltage substantially unchanged.

10. The driving method according to claim 9, wherein in the case of a positive frame, the first voltage is twice a liquid crystal molecule deflection reference voltage biased on a common electrode, the pixel voltage is a positive frame pixel voltage, in the case of a negative frame, the first voltage is equal to the liquid crystal molecule deflection reference voltage biased on the common electrode, the pixel voltage is a negative frame pixel voltage.

11. The driving method according to claim 9, wherein a drop from the first voltage to the pixel voltage is achieved by at least controlling discharge time for the capacitor.

12. The driving method according to claim 11, wherein a data signal of the data line is a pulse width modulation signal, turn-on time of the second capacitor discharging transistor being controlled by the pulse width modulation signal to thereby control the discharge time.

13. The driving method according to claim 9, wherein a turn-on degree of the second capacitor discharging transistor is controlled by at least controlling a voltage of the data line, thereby achieving a drop from the first voltage to the pixel voltage.

14. The driving method of claim 9, wherein time of the charging phase or the discharging phase is in the order of microseconds.

15. A driving circuit for a pixel circuit array, the pixel circuit array comprising a plurality of pixel circuits according to claim 1 arranged in rows and columns, wherein the driving circuit comprises:

a charging power supply for providing a charging voltage for charging the capacitor to the first voltage greater than the pixel voltage;

a gate drive module for providing a gate signal to the gate line;

a pixel voltage control module configured to provide a data signal to the data line that turns on the second capacitor discharging transistor to enable the voltage across the capacitor to drop from the first voltage to the pixel voltage.

16. The driving circuit according to claim 15, wherein the pixel voltage control module comprises a pulse width controller for outputting a pulse width modulation signal, wherein a pulse width of the pulse width modulation signal is configured to control the discharge time for the capacitor.

17. The driving circuit according to claim 16, wherein the pixel voltage control module comprises a level shifter for controlling a magnitude of a high level of the pulse width modulation signal so as to control the turn-on degree of the second capacitor discharging transistor.

18. The driving circuit according to claim 17, wherein the pixel voltage control module further comprises:

a shift register at least for receiving a digital driving signal and temporarily storing it; and an output buffer at least for outputting the pulse width modulation signal.

19. The driving circuit according to claim 15, wherein the charging power supply comprises a third transistor and a fourth transistor, the third transistor and the fourth transistor being mutually complementary transistors, a drain of the third transistor and a drain of the fourth transistor being both electrically connected to an output of the charging power supply, a gate of the third transistor and a gate of the fourth transistor being controlled by a polarity reversal control signal.

20. The driving circuit according to claim 19, wherein in the case of a positive frame, the third transistor is turned on and is inputted with a voltage twice the liquid crystal molecule deflection reference voltage biased on the common electrode; in the case of a negative frame, the fourth transistor is turned on and is inputted with the liquid crystal molecule deflection reference voltage biased on the common electrode.

* * * * *